US006510800B1

(12) United States Patent
Zaerr et al.

(10) Patent No.: US 6,510,800 B1
(45) Date of Patent: Jan. 28, 2003

(54) MULTI-UNIT RAILROAD FREIGHT CAR FOR CARRYING CARGO CONTAINERS BETWEEN CONTAINER WELL UNITS

(75) Inventors: Jon B. Zaerr, Portland, OR (US); John N. Niosi, Portland, OR (US); David W. Smith, Moscow, ID (US)

(73) Assignee: Gunderson, Inc., Portland, OR (US)

( * ) Notice: Subject to any disclaimer, the term of this patent is extended or adjusted under 35 U.S.C. 154(b) by 0 days.

(21) Appl. No.: 09/976,655

(22) Filed: Oct. 12, 2001

(51) Int. Cl.[7] ..... B61D 17/20

(52) U.S. Cl. ..... 105/4.1; 105/4.2; 105/355

(58) Field of Search ..... 105/355, 4.1, 4.2, 105/4.3, 418, 413, 419, 404, 422, 199.3; 410/55, 56, 54

(56) References Cited

U.S. PATENT DOCUMENTS

| | | | | | |
|---|---|---|---|---|---|
| 1,110,394 | A | | 9/1914 | Lindall | 105/3 |
| 1,114,552 | A | | 10/1914 | Taurman | 105/3 |
| 1,168,335 | A | * | 1/1916 | Rowntree | 105/2 |
| 1,617,658 | A | | 2/1927 | Suarez | 105/4.1 |
| 1,634,490 | A | | 7/1927 | Collis | 105/1.4 |
| 4,150,628 | A | | 4/1979 | Keldenich | 105/367 |
| 4,428,296 | A | * | 1/1984 | Scheuchzer et al. | 104/2 |
| 4,703,699 | A | | 11/1987 | Hill | 105/355 |
| 4,798,148 | A | | 1/1989 | Girard | 105/17 |
| 4,864,938 | A | * | 9/1989 | Hesch et al. | 105/4.1 |
| 4,893,567 | A | | 1/1990 | Hill et al. | 105/419 |
| 4,929,132 | A | | 5/1990 | Yeates et al. | 410/56 |
| 4,947,760 | A | * | 8/1990 | Dawson et al. | 105/3 |
| 4,949,646 | A | * | 8/1990 | Jamrozy et al. | 105/406.1 |
| 4,951,575 | A | | 8/1990 | Dominguez et al. | 105/406.1 |
| 4,955,144 | A | | 9/1990 | Lienard et al. | 105/4.2 |
| 5,090,331 | A | * | 2/1992 | Hesch et al. | 105/3 |
| 5,170,718 | A | * | 12/1992 | Hill et al. | 105/404 |
| 5,197,392 | A | | 3/1993 | Jeunehomme | 105/3 |
| 5,207,161 | A | * | 5/1993 | Pileggi et al. | 105/4.1 |
| 5,279,230 | A | | 1/1994 | Thomas et al. | 105/355 |
| 5,372,073 | A | | 12/1994 | Cattani | 105/3 |
| 5,423,269 | A | | 6/1995 | Saxton et al. | 105/355 |
| 5,511,491 | A | | 4/1996 | Hesch et al. | 105/404 |
| 5,626,083 | A | | 5/1997 | Saxton | 105/355 |
| 6,095,055 | A | | 8/2000 | Lohr et al. | 105/4.2 |
| 6,199,486 | B1 | | 3/2001 | Landrum et al. | 105/396 |

OTHER PUBLICATIONS

Car and Locomotive Cyclopedia, 1997, p. 207: TTEX "Long Runner" car.

U.S. patent application Ser. No. 09/976,690, Smith et al., filed Oct. 12, 2001.

* cited by examiner

*Primary Examiner*—S. Joseph Morano
*Assistant Examiner*—Frantz F. Jules
(74) *Attorney, Agent, or Firm*—Chernoff, Vilhauer, McClung & Stenzel, LLP

(57) ABSTRACT

A multi-unit railroad freight car and a container-carrying intermediate unit for such a car. The intermediate unit is located between and coupled to each of a pair of well units designed for carrying stacked cargo containers. Coupled ends of the intermediate units and adjacent container well units are supported on a shared truck. The intermediate unit includes a center sill, transverse bolsters atop the center sill, and container supporting arms extending from the bolsters and above body bolsters of the adjacent container well units.

16 Claims, 5 Drawing Sheets

MULTI-UNIT RAILROAD FREIGHT CAR FOR CARRYING CARGO CONTAINERS BETWEEN CONTAINER WELL UNITS

BACKGROUND OF THE INVENTION

The present invention relates to multi-unit railroad freight cars, and in particular to such a car including container well units.

Within the limits of available space along railroad tracks and the ability of the tracks to support loaded freight cars safely, it is economically desirable to carry as heavy a load of revenue-earning cargo as possible in a given train length. Increased cargo weight for a given train length gives increased cost efficiency, since the train crew wages, train mile and fuel expenses, and locomotive costs are shared by the increased amount of cargo revenue.

Freight cars including multiple well units for carrying stacked intermodal cargo containers are well known. Some of these cars have shared trucks to support adjacent well units. Others use drawbars to interconnect adjacent units that are each fully supported by their own trucks. In both of these types of multi-unit container well cars the large space between the ends of containers carried in adjacent well units results in a significant amount of aerodynamic drag during train operation and leaves a significant portion of the length of a train in which no cargo containers are present.

Within the railroad industry there are regulations in effect limiting the maximum weight of a loaded intermodal cargo container, and railroad cars are designed with ample strength to carry various combinations of capacity of such cargo containers safely and not exceed the capacity of the freight car. For example, containers of nominal 20-foot length are limited to 52,900 pounds, nominal 40-foot containers are limited to 67,200 pounds and nominal 53-foot containers may be designed for either 56,700 pounds or 67,200 pounds.

These maximum weights must be considered when loading a railroad car in order not to overstress the car body or overload its trucks and thus concentrate too much weight on the tracks. As a result, a well unit carrying two fully loaded 20-foot containers may not be able to safely carry a fully loaded 40-foot or longer container in an upper tier.

Utilization of shared trucks between adjacent well units for carrying stacked containers in such multi-unit railroad freight cars also requires restricting the weight or number of containers which can be carried stacked in those adjacent well units carried by a single shared truck, in order to avoid overloading the shared truck. This often results in the unshared truck at each end of such a multi-unit car being significantly under-loaded. As a result, such multi-unit well cars with shared trucks are often loaded to less than the optimum ratio of load weight to the length of a train of such cars.

What is desired, then, is a container-carrying, multi-unit railroad freight car that can be loaded to utilize more fully the available carrying capacity of the trucks with which such a multi-unit car is equipped, and in which the cargo weight for such a car of a given length and container well size is maximized.

SUMMARY OF THE INVENTION

The present invention overcomes some of the aforementioned drawbacks and provides an answer to some of the shortcomings of the prior art railroad cars mentioned above by providing a multi-unit railroad freight car for carrying containers, in which at least two container well units each include a container well and have respective body bolster structures adjacent their ends, in which a plurality of shared trucks each support an end of a respective one of the container well unit body bolster structures, an intermediate unit is located between two of the container well units and has a pair of opposite ends each supported on a respective one of the shared trucks supporting an end of an adjacent container well unit, and in which a container support structure included in the intermediate unit extends above the body bolster structure of the end of the adjacent container well unit.

In one embodiment of the invention the multi-unit freight, car has an intermediate unit that includes an elongate center sill including opposite sill ends and has an articulating coupler associated with each of the opposite sill ends.

One aspect of the invention is the provision of a multi-unit railroad freight car including an intermediate unit that includes a pair of transverse bolsters each attached to a center sill, and in which at least one of the transverse bolsters includes a side bearing support arm aligned with a corresponding side bearing foundation located on a respective shared truck.

In one embodiment of the invention an intermediate unit for a multi-unit railroad freight car includes a pair of container support arms associated with each of the opposite ends of the intermediate unit, and a portion of each container support arm is located above an end structure such as a body bolster of the adjacent container well unit of a multi-unit car including such an intermediate unit.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
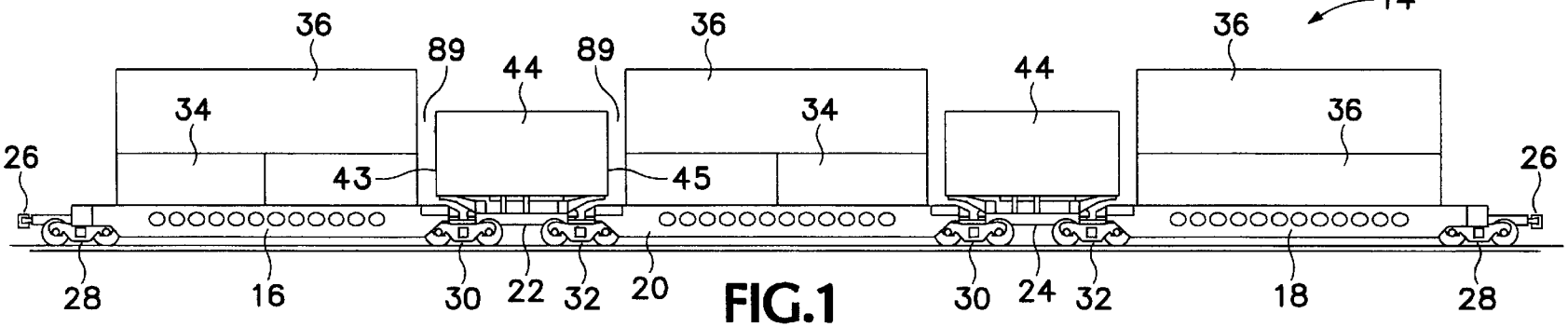
FIG. 1 is a side elevational view of a multi-unit railroad freight car which includes one preferred embodiment of the invention.

Referring now to the drawings which form a part of the disclosure herein, a multi-unit railroad freight car 14 embodying the present invention is shown in FIG. 1. The freight car 14 includes five car units, of which a first container well unit 16 is at one end, a second container well unit 18 is at the opposite end, and a third container well unit 20 is in the middle of the 5-unit car. Two shorter container-supporting intermediate units 22 and 24, similar to each other, are located between the container well units. There is an ordinary automatic coupler 26 at each end of the 5-unit car 14 for use in coupling the multi-unit car 14 to other cars of a train.

A respective truck 28, for example, a 70-ton truck, is located at each end of the car 14, supporting the outer ends of the two end well units 16 and 18. Shared trucks 30 and 32, for example, 100-ton trucks, support the rest of the multi-unit car.

Figure 2:
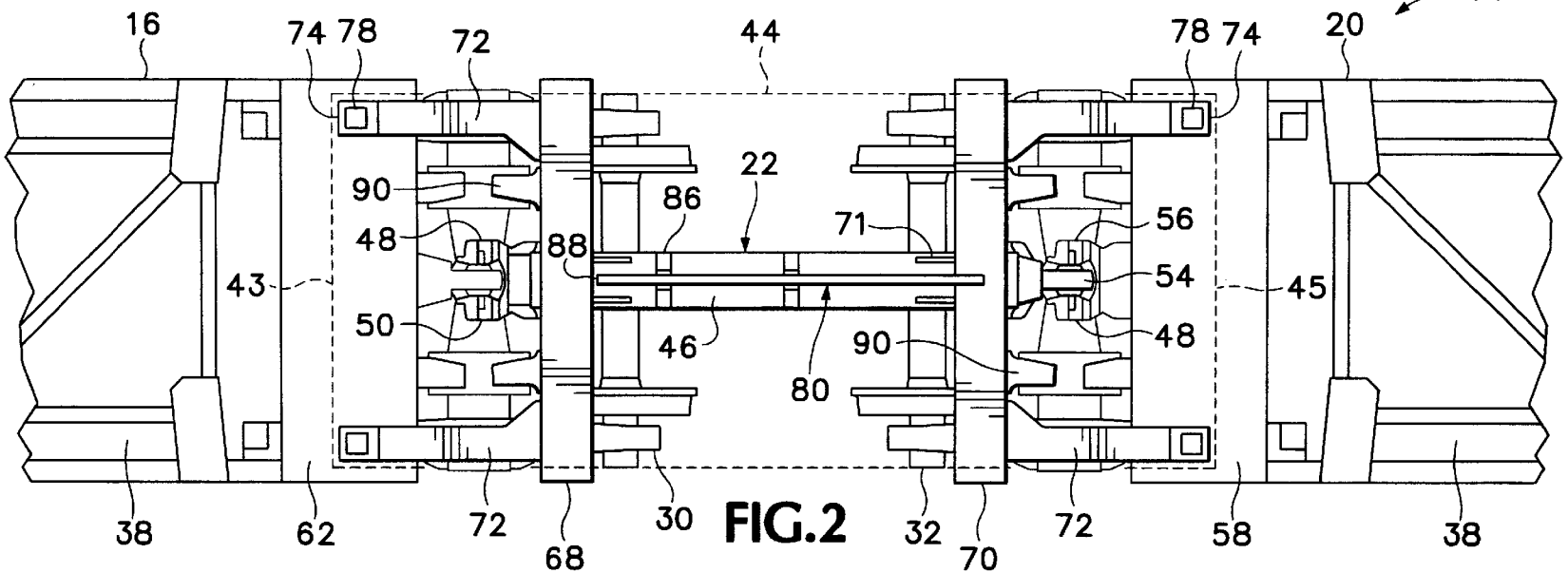
FIG. 2 a top plan view of a portion of the multi-unit railroad freight car shown in FIG. 1.
Figure 3:
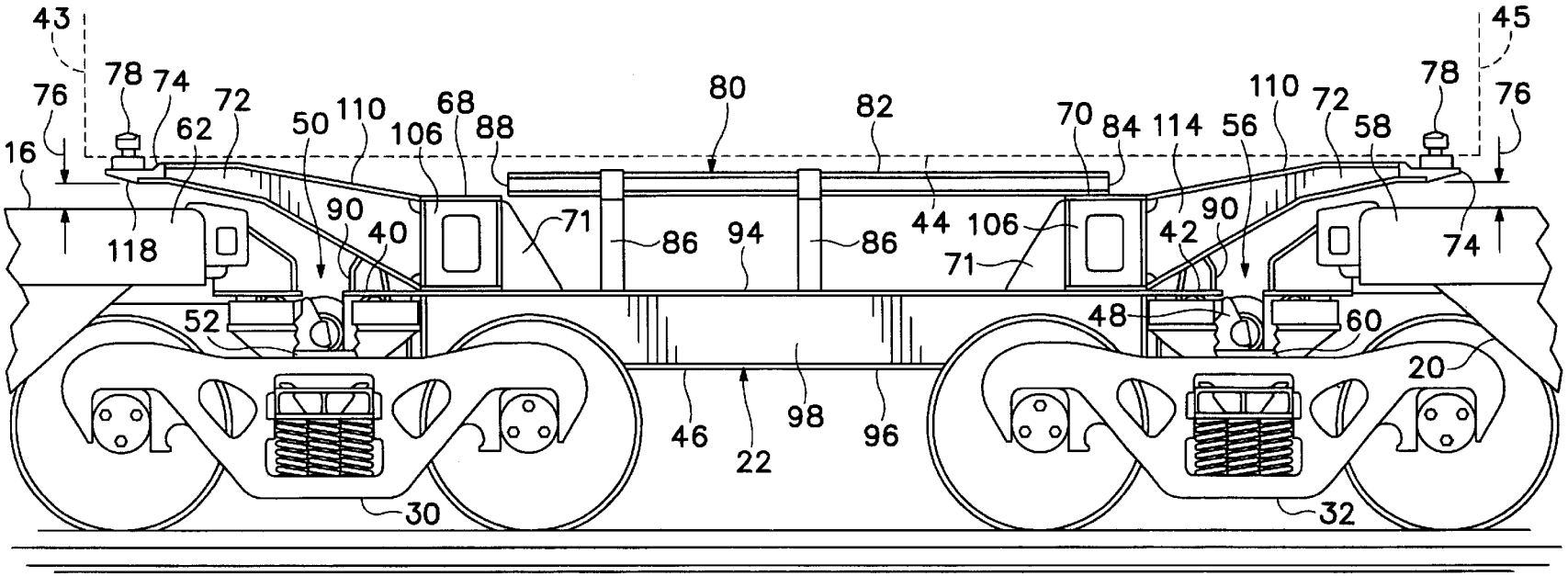
FIG. 3 is a side elevational view of a portion of the car shown in FIG. 1, including a container-supporting intermediate unit together with portions of adjacent container well units.
Figure 4:
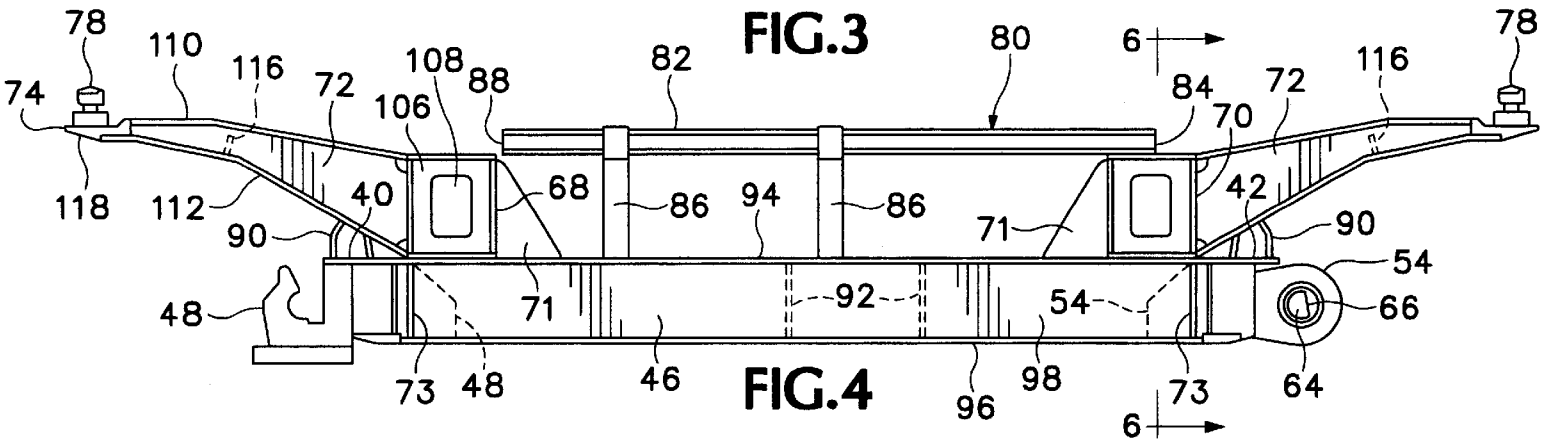
FIG. 4 is a side elevational view of the underframe of the container-supporting intermediate unit shown in FIG. 3, separate from the adjacent well units and shared trucks.

As shown in FIGS. 2 and 3, each well unit 16, 18, or 20 may, for example, be generally similar to the well car units disclosed in Hill U.S. Pat. No. 4,599,949, but preferably without end bulkheads, and is capable of carrying a pair of 20-foot intermodal cargo containers 34 or a single 40-foot container 36 in its well 38, with a 40-foot container 36 stacked on top of the container 36 or containers 34 carried in the well 38.

Each of the container-supporting intermediate units 22 and 24 is located between two adjacent ones of the well units 16, 18, and 20, and each end 40 or 42 of each intermediate unit is supported by a respective shared truck 30 or 32. Each of the intermediate units 22 and 24 supports an intermodal cargo container 44 at a location higher than that for each of the containers 34 or 36 held within the well 38 of one of the well units 16, 18 or 20. Each end 43 or 45 of the container 44 is located above a portion of the end structure of the adjacent well unit. The container 44, as shown, is a nominal 20-foot container, but the intermediate units 22 and 24 could be constructed to carry containers of other lengths instead, if desired.

Each container-supporting intermediate unit 22 and 24 includes an underframe including longitudinal and transverse structural members for supporting cargo and train loads and receiving couplers to connect the intermediate unit to the adjacent well units. The underframe has structural members attached thereto for supporting a container high enough to extend above an end structure such as a body bolster of an adjacent well unit.

As shown in FIGS. 2, 3, 4, and 5, in the multi-unit car 14 each of the container-carrying intermediate units 22 and 24 is in the form of a spine unit, although other structural arrangements might be utilized instead. As the intermediate units 22 and 24 are similar, only the intermediate unit 22 will be referred to, together with the adjacent well units 16 and 20, for the sake of simplicity, and it will be understood that the intermediate unit 24 is of similar construction and is similarly related to the respective adjacent well units 20 and 18.

A longitudinally extending horizontal center sill 46 of the intermediate unit 22 is equipped at its first end 40 with a female portion 48 of an articulated coupling 50 which connects the container-carrying intermediate unit 22 to the adjacent well unit 16, as shown best in FIGS. 2 and 3, with the coupling supported on the center bearing 52 of the shared truck 30. At the second end 42 of the center sill 46 is a male portion 54 of a similar articulated coupling 56. The male portion 54 of the coupling 56 is-interconnected with and supported on the female portion 48 of the coupling 56, which is mounted on the adjacent body bolster 58 of the container well unit 20 to which the end 42 of the intermediate unit 22 is coupled. The articulated coupling 56 is supported on the center bearing 60 of the shared truck 32.

Correspondingly, a male portion 54 of the articulated coupling 50 is mounted on the body bolster 62 of the container well unit 16, to which the end 40 of the intermediate unit 22 is coupled.

One suitable articulated coupling 50 or 56, as shown herein, is of the type utilizing a center bearing having a vertical axis of rotation with respect to the respective shared truck and including a female portion 48 having an upwardly open pair of hook-like members, while the other, or male, portion 54 of the coupling includes a transverse horizontal pin 64 extending through a captured ball. One such coupling is available from Cardwell Westinghouse Co., of Chicago, Ill. In such a coupling a pair of locking wedges (not shown) are attached to the female coupling portion 48 and rest against flat sides 66 of the horizontal connecting pin 64 to keep the coupling portions 48 and 54 engaged with each other.

Located atop and welded to the center sill 46, adjacent its ends, are respective horizontal transverse bolsters 68 and 70. Heavy steel gusset plates 71 and 73 help to interconnect each transverse bolster 68, 70 to the top of the center sill 46.

Attached to and extending longitudinally outward from each transverse bolster 68, 70 are a respective pair of container support arms 72 that extend beyond the respective ends of the center sill 46. The container support arms 72 are tapered in height, and each of them extends slopingly upward and away from the respective transverse bolster 68 or 70. An outer end portion 74 of each of the container support arms 72 extends above and is spaced upwardly apart from the body bolster 58 or 62 of the adjacent well unit 20 or 16, with sufficient clearance 76 to accommodate normal relative movement between the intermediate unit 22 or 24 and the adjacent well units 16, 18 and 20 during operation of the car 14 in a train.

Respective twist-lock container-fastening hold-down devices 78 are mounted on the outer ends of the container support arms 72 at locations corresponding with the standard placement of container structures defining lifting and stacking apertures to retain and provide direct support for a cargo container 44 carried by the intermediate unit 22.

A container floor safety support assembly 80 extends longitudinally above the center sill 46 of the intermediate unit so as to be a small distance beneath a container 44 carried on the container-supporting intermediate unit 22. As shown in FIGS. 2, 3, 4 and 5, the container floor safety support assembly 80 includes as its main member an I-beam 82, one end 84 of which is securely fastened, as by welding, to the top of the transverse bolster 70. A pair of flanged, tapered, upright supports 86 extend upwardly from the top of the center sill 46 to support the I-beam 82 at respective locations spaced apart from the transverse bolster 70, while the opposite end 88 of the I-beam extends beyond the farther one of the supports 86, but is not attached to the transverse bolster 68. This enables the container floor safety support assembly to accommodate flexing of the container-carrying intermediate unit 22 during operation of a train including the multi-unit car 14 disclosed herein.

By supporting the container 44 atop the container support arms 72 extending above the body bolsters 58 and 62 of the adjacent well units 20 and 16, the container-supporting intermediate unit 22 disclosed herein places the ends 43 and 45 of the container 44 closer longitudinally to a container 34 or 36 or stacked containers carried in the adjacent well units 16 and 20 than is possible in conventional multi-unit container-carrying well cars. The length of the gap 89 between longitudinally adjacent containers may thereby be made as small as about 2 feet, and a smaller aerodynamic drag is produced, accordingly, than by containers carried on conventional container-carrying well car units interconnected with each other by either a drawbar or a shared truck.

Attached to each of the transverse bolsters 68 and 70 of the intermediate unit 22 are a pair of side bearing support arms 90 spaced apart from each other and arranged to rest on side bearings mounted on the shared truck 30 or 32, in a conventional arrangement as shown in FIG. 2, to control lateral rocking of the intermediate unit 22 with respect to the shared trucks 30 and 32. Since each container well unit 16, 18 and 20 also has side bearings to limit its movement with respect to each truck 30 or 32, this side bearing arrangement of the intermediate unit 22 also limits the ability of the intermediate unit 22 to roll laterally with respect to the body bolster 58 or 62 of the adjacent well unit carried on the same shared truck 30 or 32. The container support arms 72 are thus prevented from coming into contact with the body bolsters 58 and 62 and interfering with relative movement of the intermediate unit 22 and the adjacent well units.

The multi-unit freight car 14 may be constructed as shown with a length of about 192 feet and a cargo capacity of 624,800 pounds in eight 20-foot-containers and three 40-foot containers, for a cargo capacity of about 32,60 pounds of cargo for each foot of car length.

Figure 5:
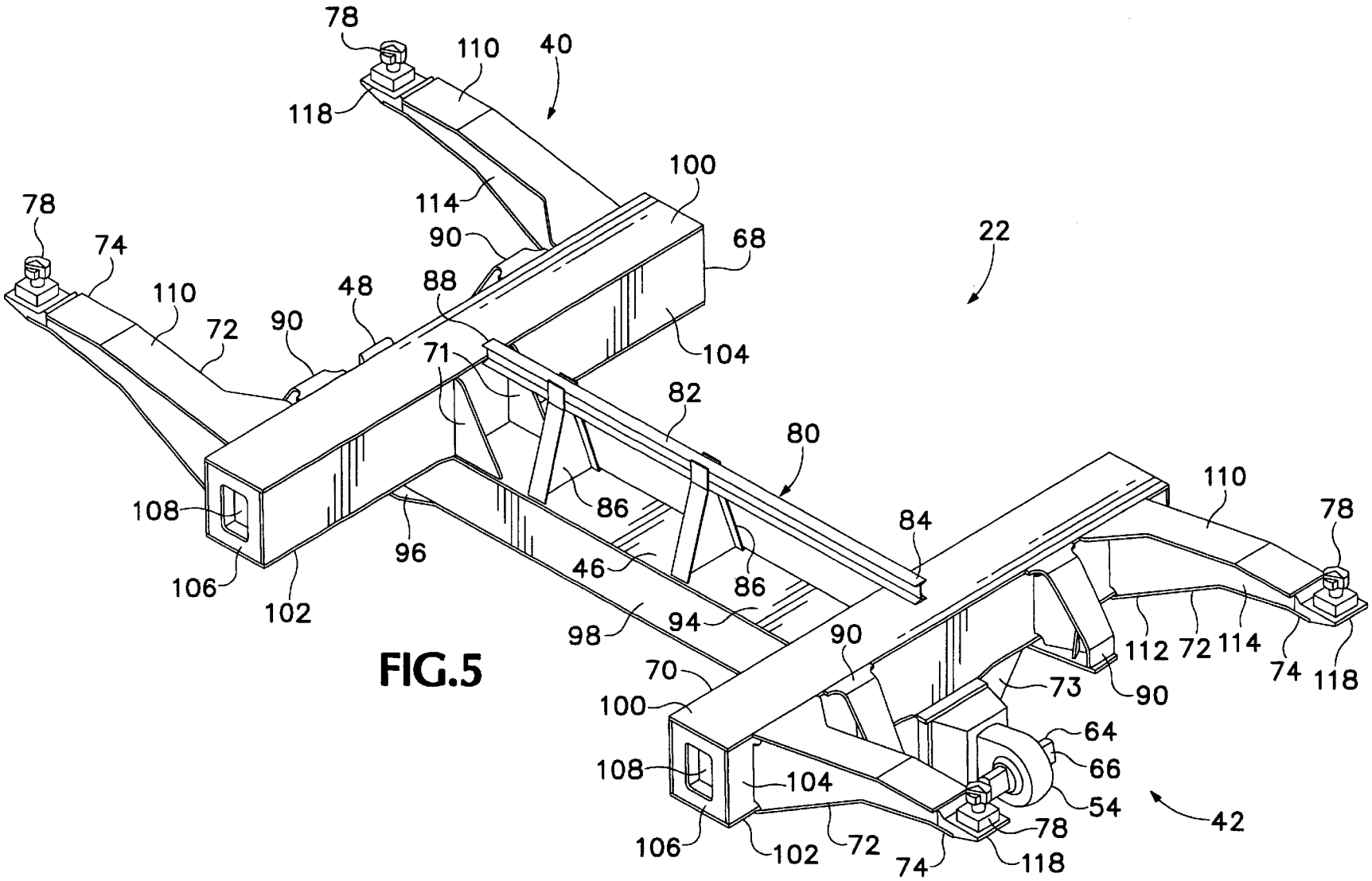
FIG 5 is an isometric view of the underframe of the container-carrying intermediate unit shown in FIGS. 3 and 4.
Figure 6:
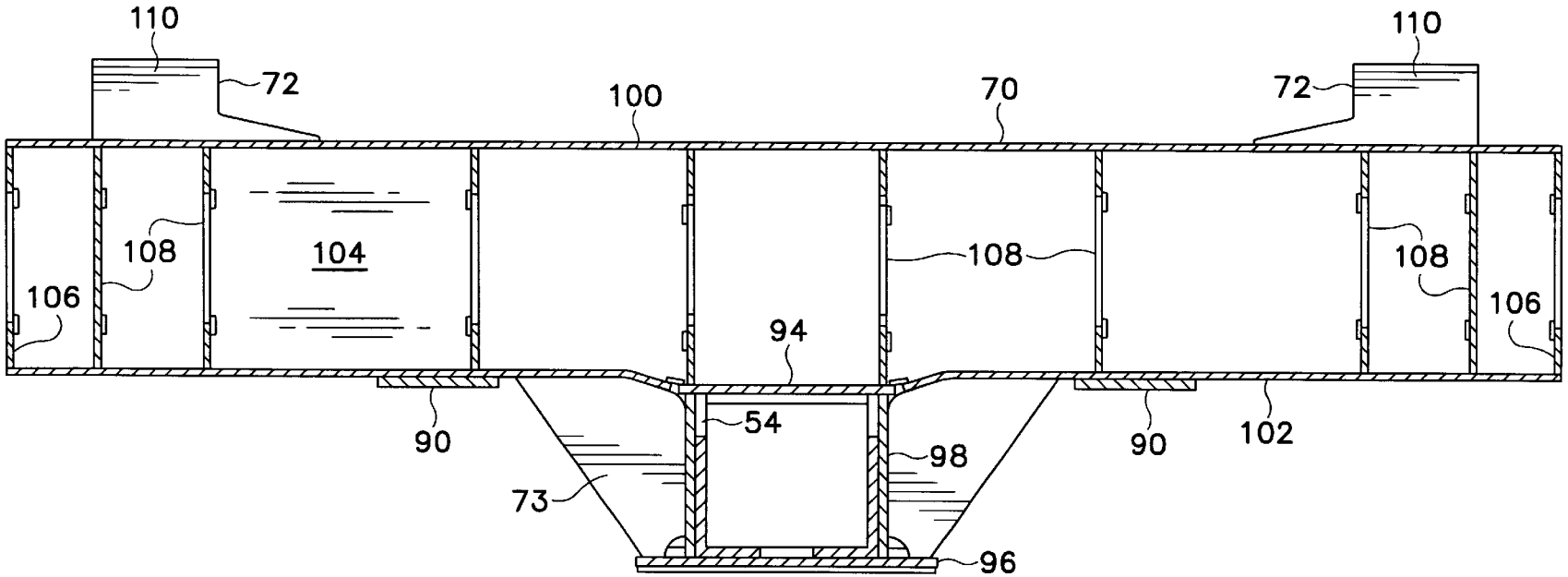
FIG. 6 is a sectional view taken along line 6—6 of FIG. 4.

Referring now also to FIGS. 5 and 6, in the container-supporting intermediate unit 22, the center sill 46 may be a weldment of steel plates in a box beam arrangement reinforced by the articulating coupler portions 48 and 54 at the ends. Suitable internal webs or diaphragms 92 may be located, for example, as shown in broken line in FIG. 4 to provide additional support where equipment such as brake gear (not shown) is attached. Preferably, top and bottom plates 94, 96 and side plates 98 may be of material such as steel plate ⅝ inch thick.

Similarly, the transverse body bolsters 68 and 70 are preferably also weldments of steel plate, with horizontal top and bottom plates 100, 102, each ½ inch thick, for example, and with vertical side plates 104 which may be of somewhat lighter material. Support is provided by diaphragms 106 at each end of each bolster, as well as by other diaphragms 108 in locations aligned with the container support arms 72, the side plates 98 of the center sill 46, and with the side bearing support arms 90, as shown in FIG. 6.

The container support arms 72 are also preferably of a modified box beam construction of suitable welded steel plates, and are tapered toward their outer ends 74 from a greatest height adjacent the respective transverse bolster 68 or 70. A top plate 110 is of greater thickness than a bottom plate 112 and side plates 114 of each container support arm 72, and each container support arm 72 preferably also includes a reinforcing web 116 located, for example, as shown in broken line in FIG. 4. The outer end portion 74 of each container support arm 72, spaced farthest away from the respective transverse bolster 68 or 70, may preferably be formed as a casting 118 welded to the modified box beam structure just described, to provide a rigid foundation for the twist lock container hold-down devices 78 mentioned previously.

Figure 7:
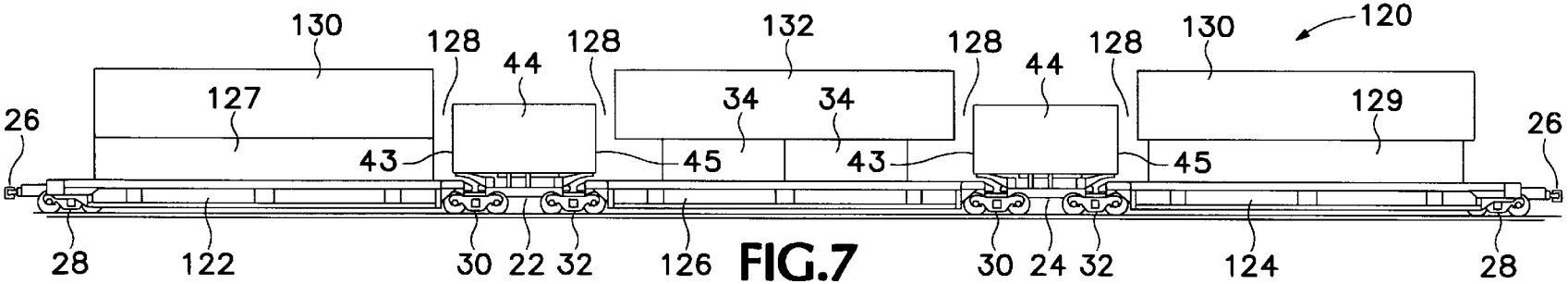
FIG. 7 is a side elevational view of a multi-unit railroad/freight car which is another embodiment of the present invention.
Figure 8:
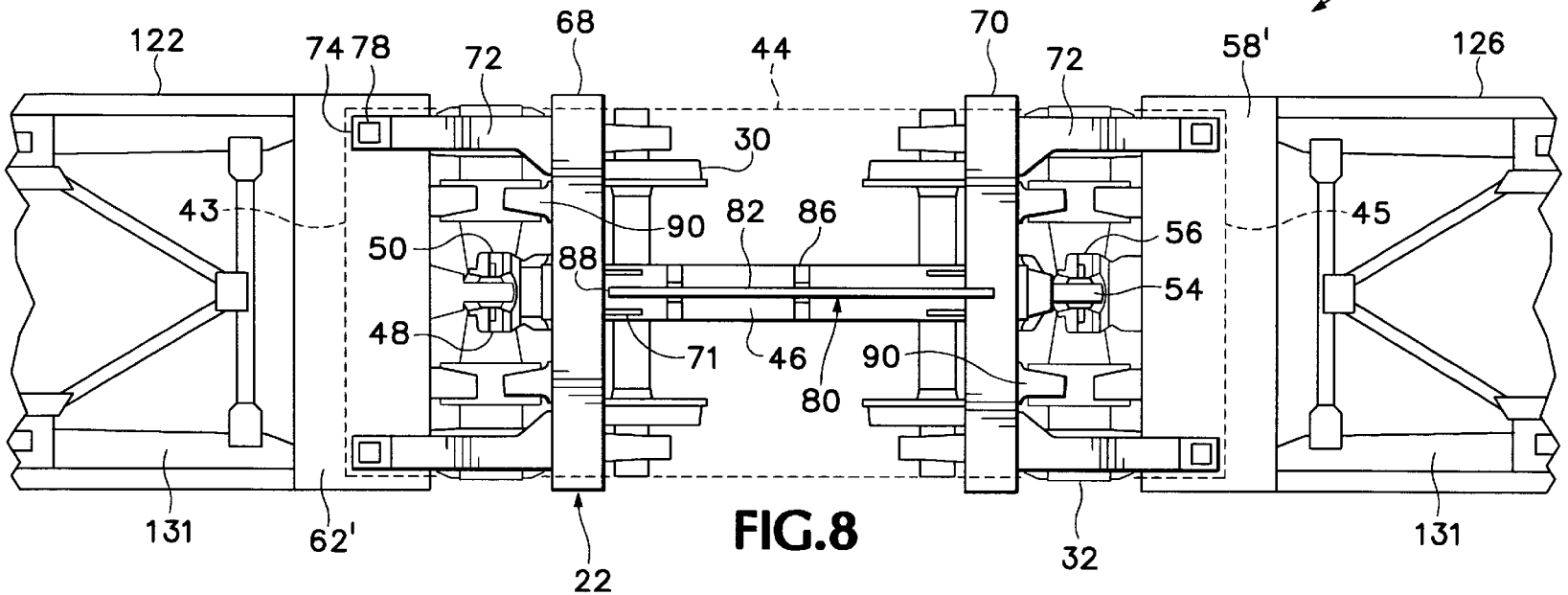
FIG. 8 is a top plan view of a portion of the multi-unit railroad freight car shown in FIG. 7.

Referring to FIGS. 7 and 8, a multi-unit railway freight car 120 is generally similar to the freight car 14 shown in FIGS. 1 and 2. The car 120, however, includes three similar container well units 122, 124, and 126, of somewhat different construction from the well units 16, 18 and 20, with body bolsters 58' and 62' at respective ends of well unit bodies defining respective container wells 131 that are capable of receiving intermodal cargo containers of greater lengths, such as 53-foot containers 127 or 48-foot containers 129, as well as 40-foot containers 36 or pairs of 20-foot containers 34. Other, preferably 53-foot, containers 130 and 132 can be stacked atop the containers 127, 129 or 34 carried in the wells 131 in various configurations, as shown in FIG. 7, while containers 44 are carried on the intermediate units 22 and 24 coupled to the well units 122, 124 and 126.

FIG. 8 shows in top plan view a portion of the structure of the well units 122 and 126 of the freight car 120, each of which may be generally similar to the container well units shown in Hill et al, U.S. Pat. No. 4,893,567. The multi-unit freight car 120 shown in FIGS. 7 and 8, despite the greater weight of the well units 122, 124 and 126, and the longer containers that can be carried thereon, includes end trucks 28 that may be of 70 ton capacity, and its shared trucks 30 and 32 may be of 100 ton capacity, when the intermediate units 22 and 24 are built to carry containers 44 of standard 20-foot size. Such a multi-unit car 120 can be built to have an overall length of about 231 feet over the pulling faces of the end couplers 26 and with a spacing of about 24 feet between 53-foot containers carried in the well units, leaving a longitudinal gap 128 of about 2 feet between each end 43 or 45 of the container 44 and a 53-foot container 130 or 132 carried in an adjacent-well unit. The multi-unit car 120 can then carry a container cargo of eight 20-foot containers 34 and 44, two 53-foot containers 130 loaded to 56,700 pounds in the upper tier of the end well units 122 and 124, and a third 53-foot container 132 loaded to 67,200 pounds in the upper tier of the center well unit 126, giving a cargo capacity of 603,000 pounds, or about 2,610 pounds of cargo for each foot of car length.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A multi-unit railroad freight car, comprising:

(a) at least two container well units, each defining a container well and each including a pair of body bolsters;

(b) a plurality of trucks, a respective one of said trucks supporting each said body bolster of each of said container well units;

(c) an intermediate unit located between two of said container well units, said intermediate unit having a pair of opposite ends, each of said opposite ends of said intermediate unit being coupled to a respective one of said container well units and being carried on a respective shared one of said trucks together with one of said body bolsters of said respective one of said container well units; and (d) a container support structure included in said intermediate unit, a portion of said container support structure extending above and being spaced upwardly apart from one of said body bolsters of one of said container well units.

2. The multi-unit railroad freight car of claim 1 wherein said intermediate unit includes a center sill having a pair of opposite sill ends and including an articulating coupler associated with each of said opposite sill ends.

3. The multi-unit railroad freight car of claim 1 wherein said intermediate unit includes a center sill having a pair of opposite sill ends and a pair of transverse bolsters, each of said transverse bolsters being attached to said center sill adjacent a respective one of said opposite sill ends.

4. The multi-unit freight car of claim 3, said container support structure including a side bearing support arm mounted on one of said transverse bolsters and aligned with a corresponding side bearing foundation located on said respective shared one of said trucks.

5. The multi-unit railroad freight car of claim 3, said intermediate unit including a container floor support member extending longitudinally above and being spaced upwardly apart from said center sill.

6. The multi-unit railroad freight car of claim 5 wherein said container floor support member is attached to only one of said transverse bolsters and extends toward the other of said bolsters, but is free to move with respect to said other one of said transverse bolsters.

7. The multi-unit railroad freight car of claim 6 including an upright support interconnecting said center sill with said container floor support member.

8. The multi-unit railroad freight car of claim 1 wherein said container support structure of said intermediate unit includes a respective pair of container support arms associated structurally with each of said opposite ends of said intermediate unit, each of said container support arms including a portion thereof located above one of said body bolsters of a respective one of said container well units.

9. The multi- unit railroad freight car of claim 8 including a respective container fastening device mounted on an outer end of each of said container support arms.

10. The multi- unit railroad freight car of claim 9 wherein each of said container support arms is of welded construction and includes an end casting, said respective container fastening device being mounted on said end casting.

11. A container-supporting intermediate unit for a multi-unit railroad freight car, comprising:

(a) a center sill having a pair of opposite sill ends;

(b) a pair of transverse bolsters interconnected with said center sill;

(c) a pair of container support arms mounted on and extending longitudinally outward from each bolster and beyond a nearer one of said opposite sill ends; and (d) an articulated coupling located on one of said opposite sill ends of said center sill and adapted to interconnect said intermediate unit with another car unit atop a shared truck of said multi-unit freight car.

12. The intermediate unit of claim 11 wherein said transverse bolsters are mounted atop said center sill adjacent said opposite sill ends thereof.

13. The intermediate unit of claim 11 wherein each of said container support arms has an outer end located higher than said transverse bolster.

14. The intermediate unit of claim 11 wherein said outer ends of said support arms are located with respect to each other in positions corresponding to those of the lifting and stacking apertures of standard intermodal cargo container.

15. The intermediate unit of claim 11 including a pair of side bearing support arms on each of said transverse bolsters.

16. A container-supporting intermediate unit for a multi-unit railroad freight car, comprising an underframe structure having longitudinal and transverse structural support members defining a pair of opposite ends of said underframe structure, an articulated coupling associated with one of said opposite ends of said longitudinal structural support member, and a container-supporting member extending longitudinally away from each of said opposite ends of said underframe structure.

* * * * *

UNITED STATES PATENT AND TRADEMARK OFFICE

CERTIFICATE OF CORRECTION

PATENT NO. : 6,510,800 B1
DATED : January 28, 2003
INVENTOR(S) : Zaerr et al.

It is certified that error appears in the above-identified patent and that said Letters Patent is hereby corrected as shown below:

Column 2,
Line 13, please delete the comma following “freight”.

Column 5,
Line 26, replace “32,60 pounds” with -- 3,260 pounds --.

Signed and Sealed this

Nineteenth Day of August, 2003

JAMES E. ROGAN
*Director of the United States Patent and Trademark Office*